US008740643B2

(12) United States Patent
Kuang et al.

(10) Patent No.: US 8,740,643 B2
(45) Date of Patent: Jun. 3, 2014

(54) ELECTRICAL RECEPTACLE CONNECTOR COMPATIBLE WITH EXISTING ELECTRICAL PLUG AND COMPLEMENTARY PLUG

(75) Inventors: Dong-Qi Kuang, Kunshan (CN); Qing-Man Zhu, Kunshan (CN); Chien-Chiung Wang, New Taipei (TW); Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 86 days.

(21) Appl. No.: 13/565,728

(22) Filed: Aug. 2, 2012

(65) Prior Publication Data

US 2013/0034994 A1 Feb. 7, 2013

(30) Foreign Application Priority Data

Aug. 2, 2011 (CN) ..... 2011 1 0219542

(51) Int. Cl.
*H01R 13/60* (2006.01)

(52) U.S. Cl.
USPC ..... 439/541.5; 439/607.23

(58) Field of Classification Search
USPC ..... 439/541.5, 79, 607.22–0.23
See application file for complete search history.

(56) References Cited

U.S. PATENT DOCUMENTS

| | | | | |
|---|---|---|---|---|
| 6,517,382 | B2 | 2/2003 | Flickinger et al. | |
| 7,070,446 | B2 | 7/2006 | Henry et al. | |
| 7,357,673 | B2 * | 4/2008 | Long | 439/607.2 |
| 7,674,133 | B2 | 3/2010 | Fogg et al. | |
| 7,764,504 | B2 * | 7/2010 | Phillips et al. | 361/715 |
| 8,197,282 | B1 * | 6/2012 | Su et al. | 439/541.5 |
| 8,328,565 | B2 * | 12/2012 | Westman et al. | 439/108 |

* cited by examiner

*Primary Examiner* — Hien Vu
(74) *Attorney, Agent, or Firm* — Ming Chieh Chang; Wei Te Chung

(57) ABSTRACT

A low profile connector having a first mating slot and a second mating slot vertically stacked above and backwardly offseted from the first mating slot, and a complementary electrical plug. The electrical plug has a first mating card and a second mating card horizontally stacked above the first mating card forwardly offseted from the first mating card. The electrical connector is matable with an existing SFP or QSFP plug, and the first mating slot are used to receive a front card edge of the existing SFP or QSFP plug.

14 Claims, 13 Drawing Sheets

ELECTRICAL RECEPTACLE CONNECTOR COMPATIBLE WITH EXISTING ELECTRICAL PLUG AND COMPLEMENTARY PLUG

BACKGROUND OF THE INVENTION

1. Field of the Invention

The present invention relates to a high speed high density electrical receptacle connector and complementary plug, and particularly to the compatibility of the electrical receptacle with an existing electrical plug.

2. Description of Related Art

U.S. Pat. No. 6,517,382 discloses a single port electrical connector and a shielding receptacle (or cage) for a pluggable transceiver module. U.S. Pat. No. 7,070,446 discloses a tall electrical connector having stacked ports and a shielding cage. U.S. Pat. No. 7,674,133 discloses an electrical connector having stacked ports with low profile.

An improved high speed high density electrical connector is desired.

SUMMARY OF THE INVENTION

In order to resolve such a need, the present invention provides an electrical connector having a first mating slot and a second mating slot vertically stacked above and backwardly offseted from the first mating slot, each mating slot extending transversely and facing forwardly for respectively receiving a front card edge of a mating plug therein, the electrical connector comprising a plurality of first contacts transversely arrayed under the first mating slot, a plurality of second contacts transversely arrayed above the first mating slot, a plurality of third contacts transversely arrayed above the second contacts and under the second mating slot, and a plurality of fourth contacts transversely arrayed above the second mating slot. The second mating slot is backwardly offseted from the first mating slot so that a vertical distance between the third contacts and the second contacts could be decreased and a profile of the electrical connector could be lower.

The present invention also provides an electrical plug comprises a shielding case, a first mating card horizontally fastened in the shielding case, and a second mating card horizontally fastened in the shielding case and stacked above the first mating card, the first mating card having a front card edge equipped with an interface at a first place, the second mating card having a front card edge equipped with another interface at a second place forwardly offseted from the first place.

Other objects, advantages and novel features of the invention will become more apparent from the following detailed description of a preferred embodiment when taken in conjunction with the accompanying drawings.

DETAILED DESCRIPTION OF THE INVENTION

Figure 1:
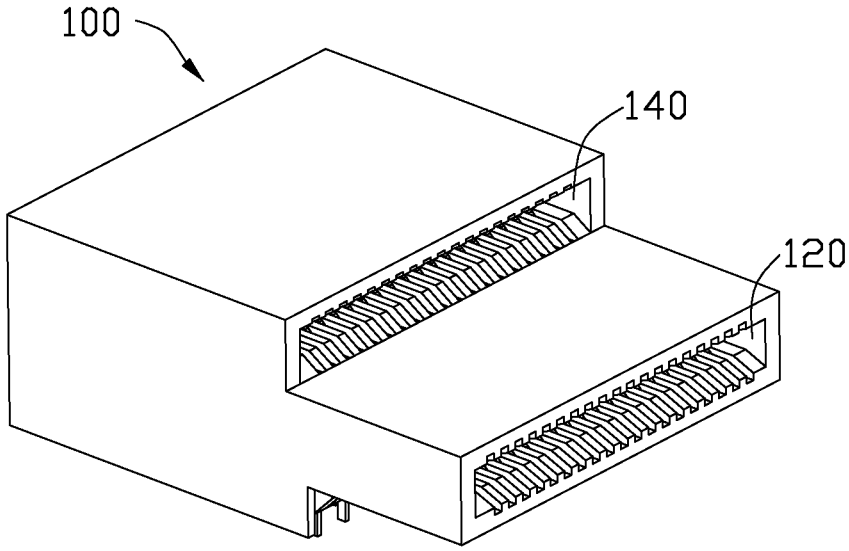
FIG. 1 is a perspective view of an assembly of an electrical connector according to an embodiment of the present invention with a shielding cage removed.
Figure 2:
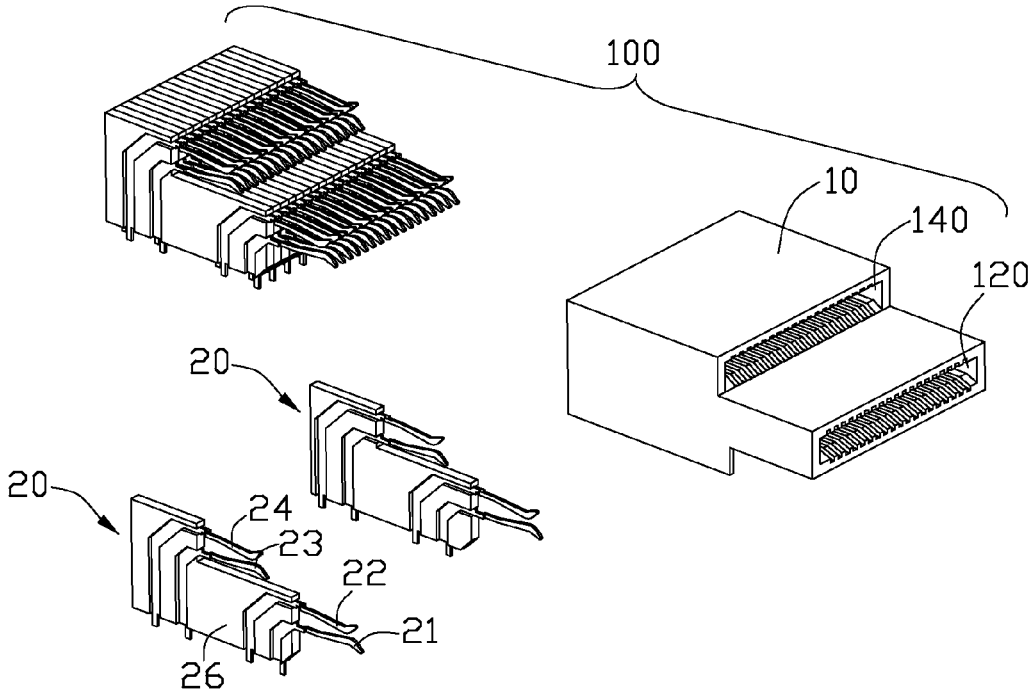
FIG. 2 is a partly exploded view of the assembly shown in FIG. 1.
Figure 3:
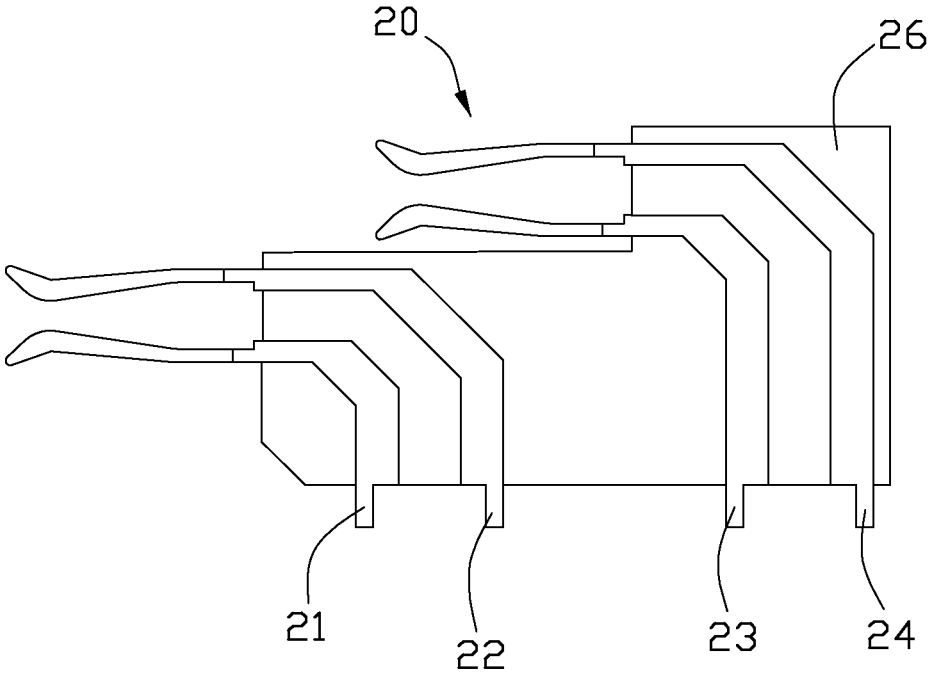
FIG. 3 is a side view of a contact module shown in FIG. 2.
Figure 4:
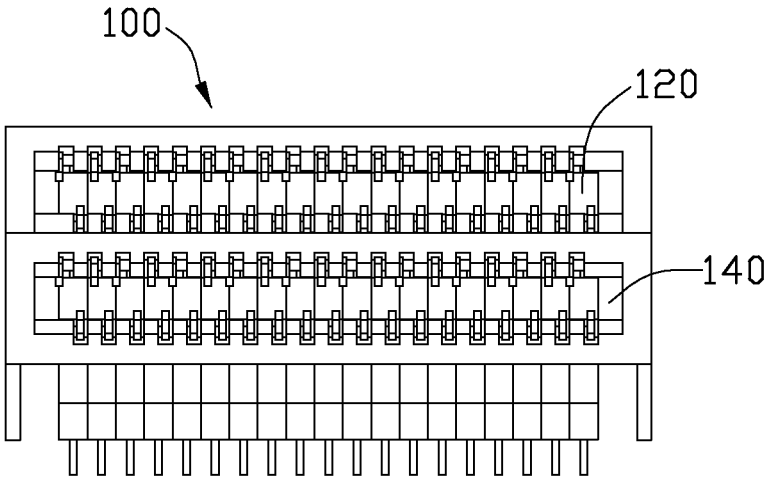
FIG. 4 is a front view of the assembly shown in FIG. 1.
Figure 5:
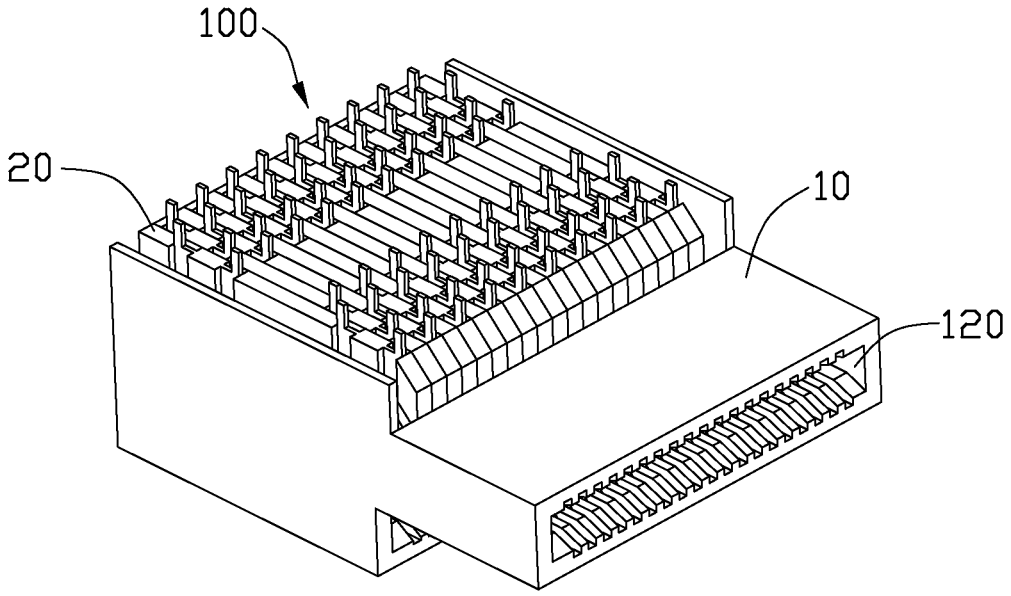
FIG. 5 is another perspective view of the assembly shown in FIG. 1.
Figure 6:
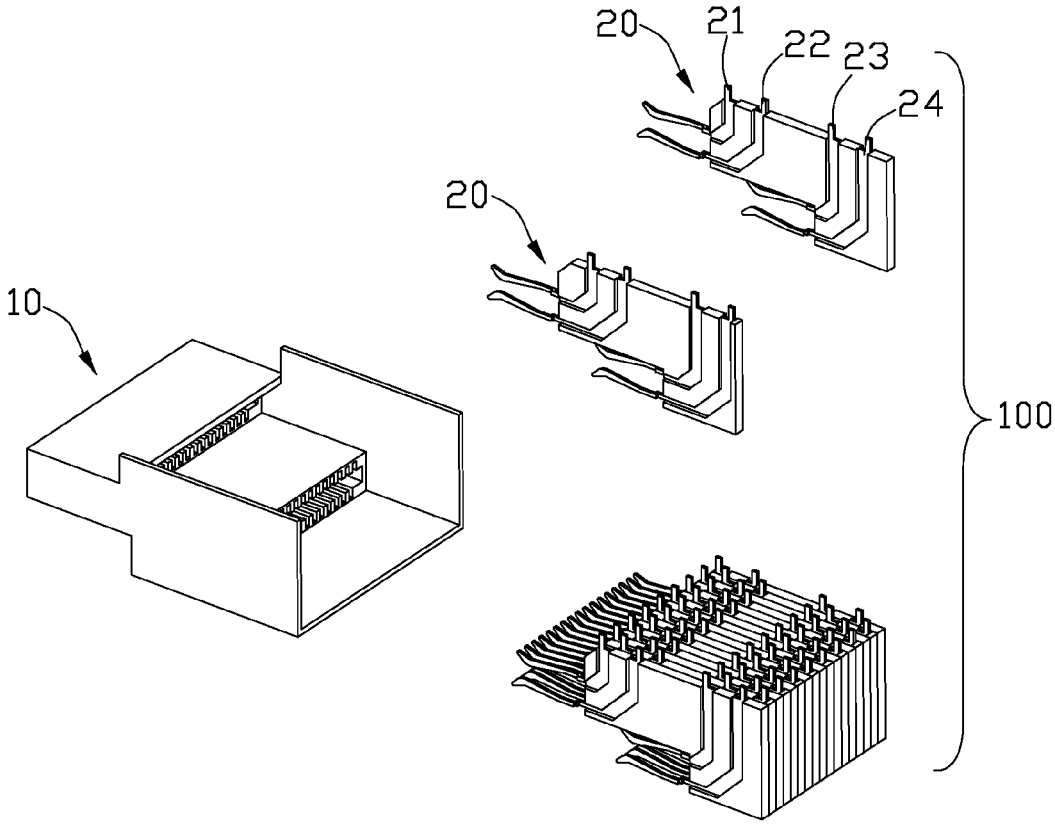
FIG. 6 is an exploded view of the assembly shown in FIG. 2 from another view point.
Figure 7:
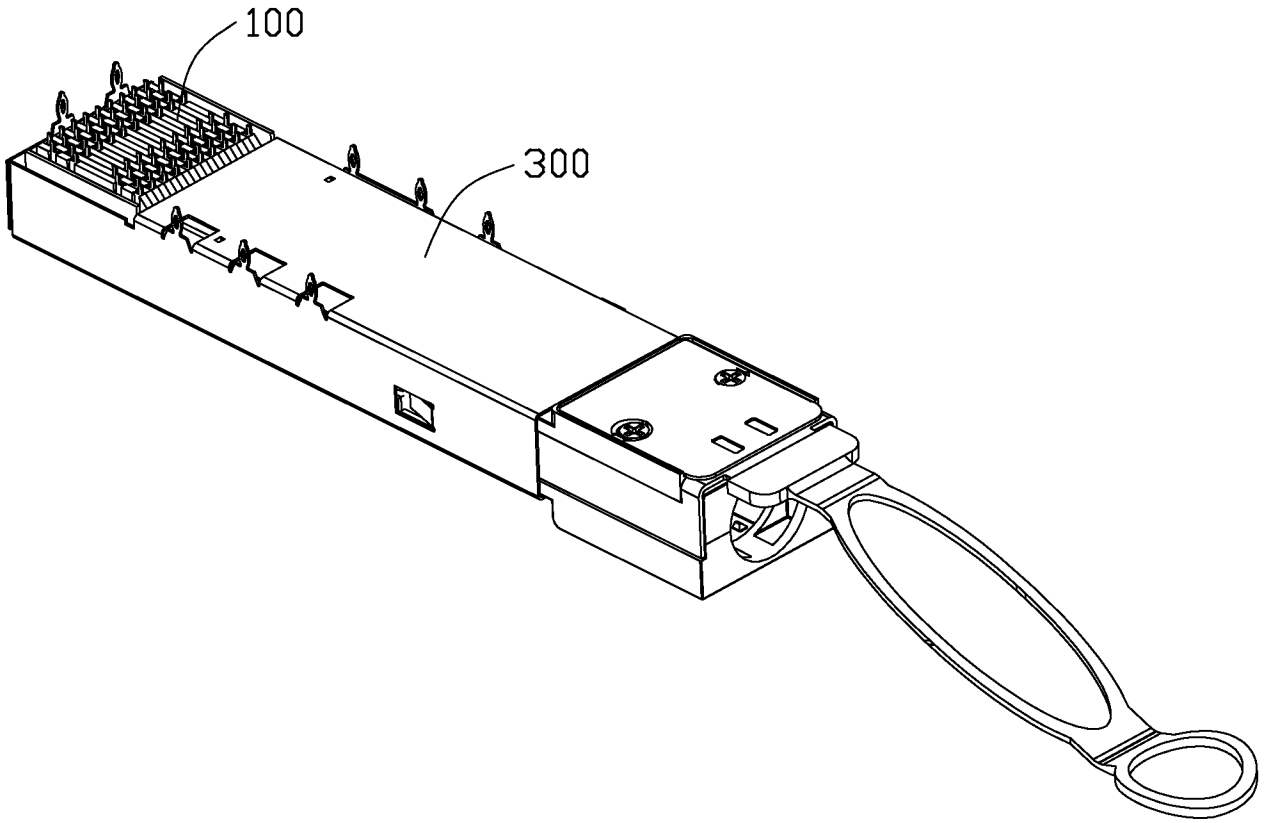
FIG. 7 is a perspective view of the electrical connector and a mated electrical plug according to the embodiment of the present invention in a mated state.
Figure 8:
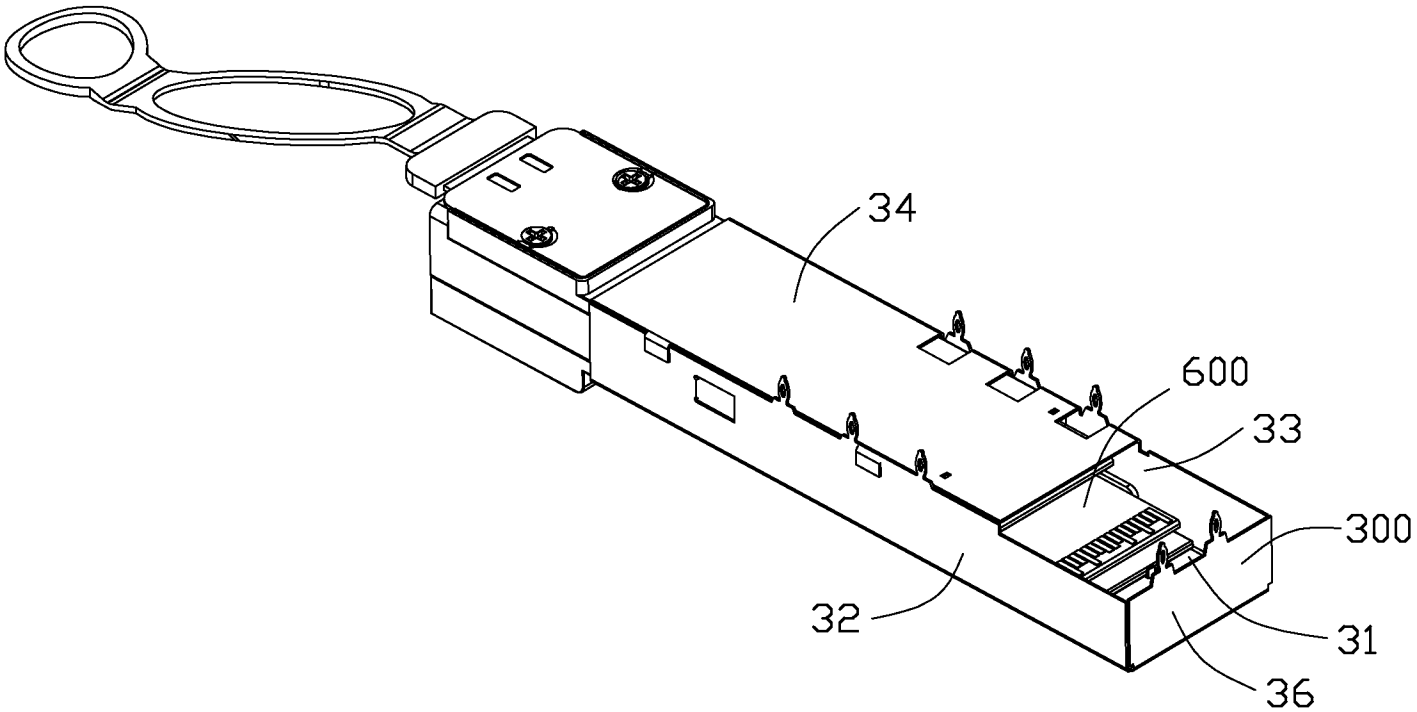
FIG. 8 is a perspective view similar to FIG. 7 except that the assembly shown in FIG. 1 is removed.

Reference will now be made to the drawing figures to describe the present invention in detail.

Figure 9:
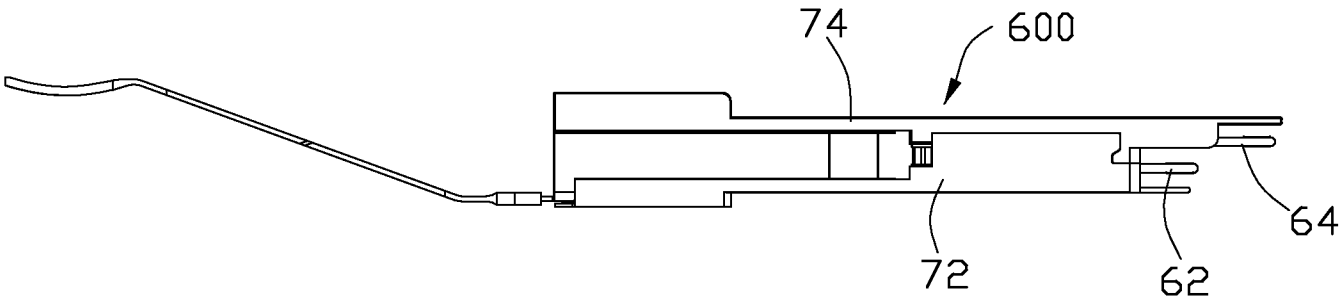
FIG. 9 is a side view of the electrical plug shown in FIGS. 6 and 7.
Figure 10:
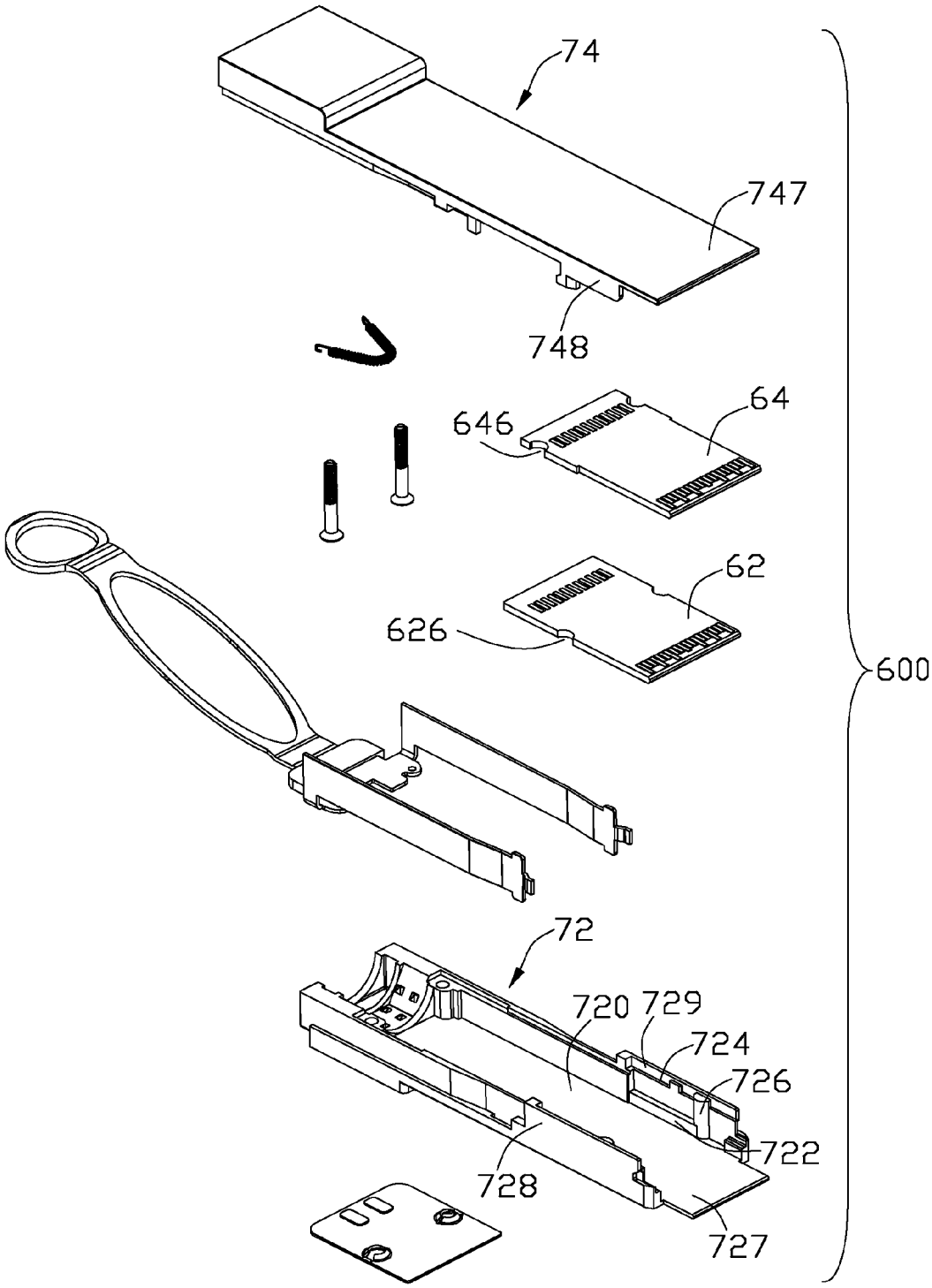
FIG. 10 is an exploded view of the electrical plug shown in FIG. 9.
Figure 11:
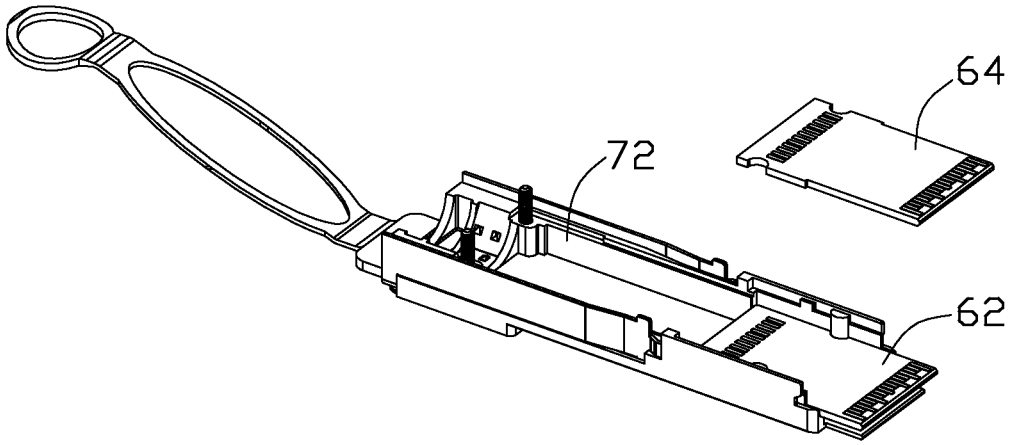
FIG. 11 is a perspective view showing a first assemblying process of the electrical connector shown in FIG. 10.
Figure 12:
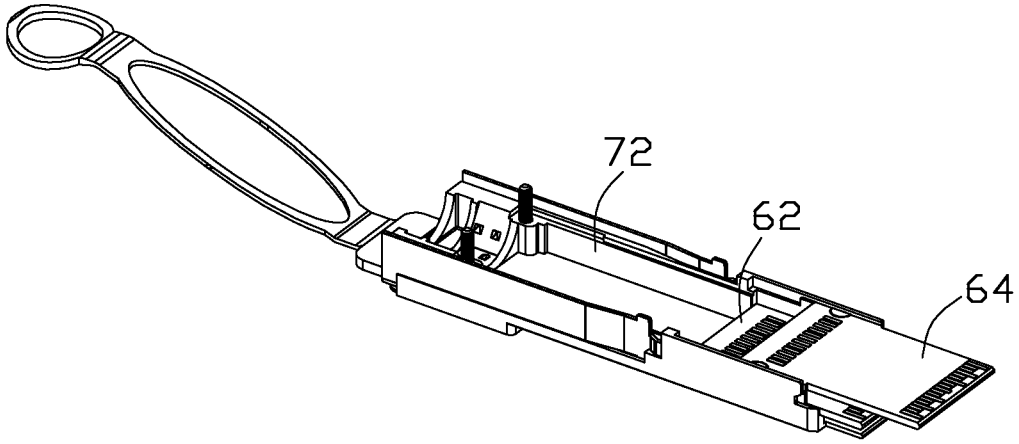
FIG. 12 is a perspective view showing a second assemblying process of the electrical connector shown in FIG. 10.
Figure 13:
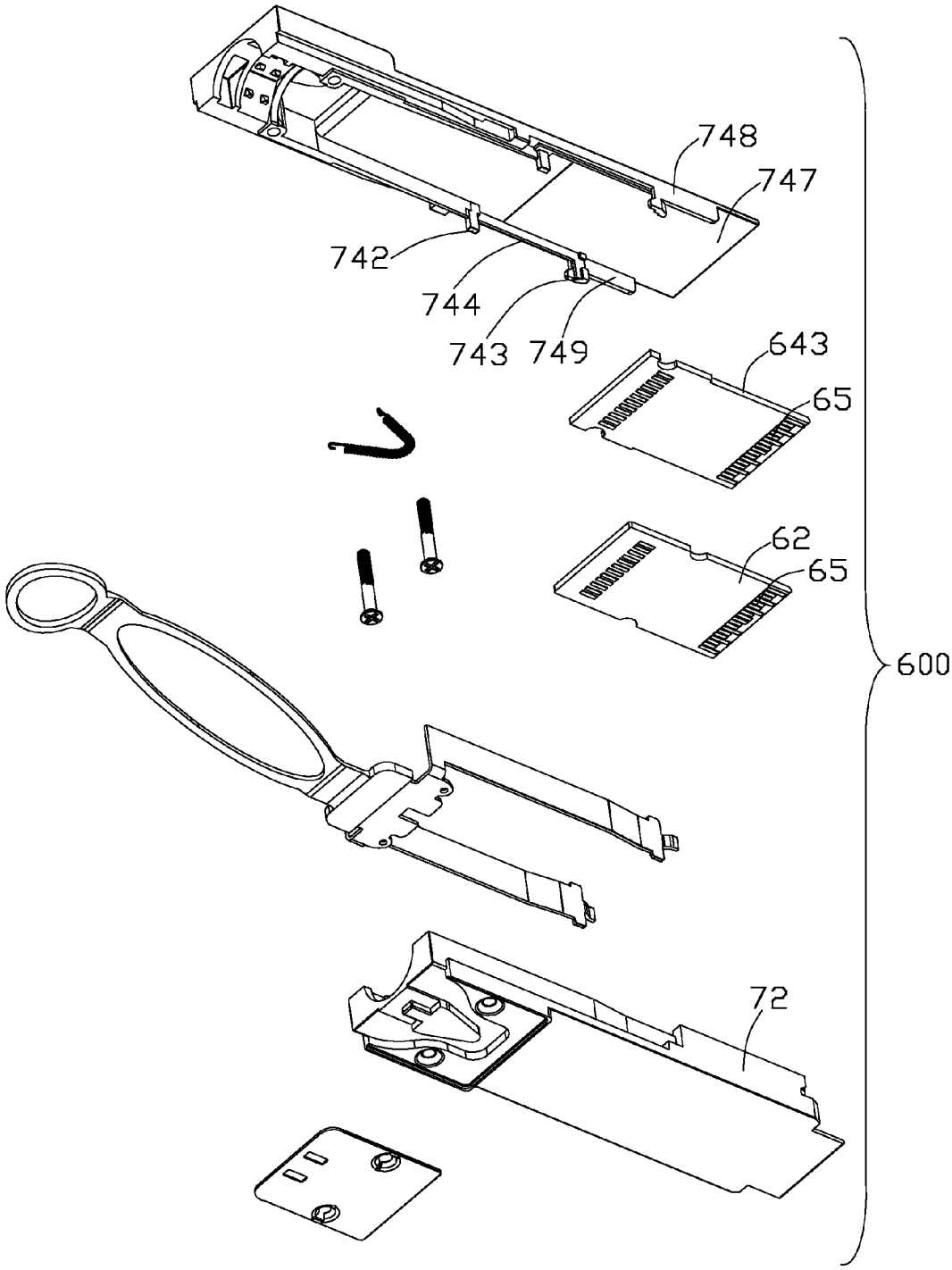
FIG. 13 is an exploded view similar to FIG. 10 from a different viewpoint.

Referring to FIGS. 1-8, an electrical connector according to an embodiment of the present invention is shown. The electrical connector includes a subassembly 100 and a shielding cage 300. The subassembly 100 has a first mating slot 120 and a second mating slot 140 vertically stacked above the first mating slot 120. Each mating slot 120, 140 extends transversely and faces forwardly for respectively receiving a front card edge of a mating plug 600 (shown in FIG. 9) therein. The electrical connector is matable with an existing QSFP plug (not shown) and the first mating slot 120 is mated with a front card edge of the existing QSFP plug. The second mating slot 140 is compatable with an interface of a front card edge of an existing QSFP plug.

The subassembly 100 of the connector comprises a unitary housing 10 and a plurality of contact modules 20 transversely stacked in the housing 10. Each contact module 20 comprises an insulator and four different contacts 21-24 inserted-molded in the insulator. The four contacts 21-24 are shaped in right angle and arrayed in a vertical plane in such manner that a first contact 21 has a horizontal contacting cantilever disposed under the first mating slot 120, a second contact 22 has a horizontal contacting cantilever disposed above the first mating slot 120, a third contact 23 disposed above the second contact 22 and under the second mating slot 140; and a fourth contact 24 has a horizontal contacting cantilever disposed above the second mating slot 140.

The second mating slot 140 is backwardly offseted from the first mating slot 120 so that a vertical distance between the third contacts 23 and the second contacts 24 could be decreased and a profile of the connector subassembly 100 could be lower. The offset distance has one more advantage is to provide an access for receiving a part of existing QSFP plug (not shown).

The unitary housing 10 defines a cavity receiving the stacked contact modules 20, and the first to fourth contacts 21-24 of each contact module 20 having foot extending downwardly out from the housing 10 and arrayed in a line from front to rear. The housing has a front protrusion with the first mating slot 120 defined therein and a rear step face above the front protrusion with the second mating slot 140 defined therein.

The metal cage 300 has a top wall 31, a bottom wall 34 and a pair of side walls 32, 33 jointly defining a passageway opening forwardly to receive the mating plug 600. The metal cage 300 further has a rear vertical wall 36 jointly with the top wall 31 and the pair of side walls 32, 33 defining a cavity. The cavity communicates a bottom open defined in the bottom wall 34. The housing 10 is received in the cavity with the foot portions of the contacts 21-24 extending out through the bottom open, and the first and the second mating slots 120, 140 communicating the passageway. It is understandable that the passageway has a same width and a same height as a passageway of a shielding cage of an existing QSFP connector.

In other embodiment of the present invention might be an electrical connector matable with an existing SFP plug, the electrical connector having a first mating slot are matable with the SFP plug and a second mating slot being compatible with a front card edge of the existing SFP plug.

The electrical plug comprises a shielding case 72, 74, a first mating card 62 and a second mating card 64. The first mating card 62 and the second mating card 64 are horizontally fastened and vertically stacked in the shielding case 72, 74. The first mating card 62 has a front card edge equipped with an interface at a first place. The second mating card 64 has a front card edge equipped with another interface at a second place forwardly offseted from the first place. The shielding case 72, 74 comprises a top cover 74 and a bottom cover 72 coupled to define a passageway receiving the first mating card 62 and the second mating card 64. The bottom cover 72 has a bottom wall 727 and two side walls 728, 729 upwardly extending from opposite side of the bottom wall 727, jointedly defining a lower portion 720 of the passageway. The top cover 74 has a top wall 747 and two side walls 748, 749 downwardly extending from opposite side of the top wall 747, jointedly defining an upper portion of the passageway. Each of the side walls 728, 729 of the bottom cover 72 defines a first step 722 upwardly supporting the first mating card 62 and a second step 724 upwardly supporting the second mating card 64. Each of the side walls 748, 749 of the top cover 74 defines two third steps 742, 743 downwardly pressing the first mating card 62 and a fourth step 744 downwardly pressing the second mating card 64. The shielding case 72, 74 defines a guiding rib 726 vertically extending along the side walls 728, 729 and innerwardly protruded. The first mating card 62 and the second mating card 64 each defines a guiding slot 626, 646 engaging the guiding rib 726. The second mating card 64 defines a pair reccesses 643 each receiving one of the third steps 743.

The disclosure is illustrative only, changes may be made in detail, especially in matter of shape, size, and arrangement of parts within the principles of the invention.

What is claimed is:

1. An electrical connector having a first mating slot and a second mating slot vertically stacked above the first mating slot, each mating slot extending transversely and facing forwardly for receiving a respective front card edge of a mating plug therein, comprising:

a plurality of first contacts having contacting cantilevers transversely arrayed in the first mating slot;

a plurality of second contacts having contacting cantilevers transversely arrayed above the first contacts;

a plurality of third contacts having contacting cantilevers transversely arrayed above the second contacts and in the second mating slot; and a plurality of fourth contacts having contacting cantilevers transversely arrayed above the third contacts;

wherein the second mating slot is backwardly offseted from the first mating slot, and the contacting cantilevers of the third contacts are backwardly offseted from the contacting cantilevers of the second contacts, thereby avoiding the interference of the contacting cantilevers of the second contacts and the third contacts when the two mating slots are mated with two front card edges of a mating plug;

wherein an unitary housing having a cavity receiving the first to fourth pluralities of contacts, wherein the housing has a front protrusion with the first mating slot defined therein and a rear step face above the front protrusion with the second mating slot defined therein; and wherein a metal cage having a top wall, a bottom wall and a pair of side walls jointly defining a passageway opening forwardly, the metal cage further having a rear vertical wall jointly with the to wall and the pair of side walls defining a cavity, the cavity communicating a bottom open defined in the bottom wall, the housing being received in the cavity with the contacts extending out through the bottom open, and the first and the second mating slots communicating the passageway.

2. An electrical connector as claimed in claim 1, further comprising a plurality of insulators, wherein each insulator holds one of the first contacts, one of the second contacts, one of the third contacts and one of the fourth contacts thereby forming a contact module.

3. An electrical connector as claimed in claim 2, wherein the insulator have a portion vertically isolating the contacting cantilever of the contacting cantilevers of the third contacting cantilever and the second contacts.

4. An electrical connector as claimed in claim 1, being matable with an existing QSFP plug, wherein the first mating slot mates with a front card edge of the existing QSFP plug when the existing QSFP plug is fully inserted into the passageway of the metal cage.

5. An electrical connector as claimed in claim 4, wherein the second mating slot is compatible with an interface of a front card edge of an existing QSFP plug.

6. An electrical connector as claimed in claim 1, being matable with an existing QSFP or SFP plug, wherein the first mating slot is adapted to receive a front card edge of said existing QSFP or SFP plug.

7. An electrical connector as claimed in claim 6, wherein the second mating slot is compatible with a front card edge of an existing QSFP or SFP plug.

8. An electrical plug, comprising:

a shielding case;

a first forward mating card horizontally fastened in the shielding case, the first forward mating card having a front card edge equipped with an interface at a first place;

a second mating card horizontally fastened in the shielding case, the second mating card vertically stacked with the first mating card and having a front card edge equipped with another interface at a second place forwardly offseted from the first place;

wherein the shielding case comprises a top cover and a bottom cover coupled to define a passageway receiving the first and the second mating cards, the bottom cover having a bottom wall and two side walls upwardly extending from opposite side of the bottom wall, jointly defining a lower portion of the passageway, the top cover having a top wall and two side walls downwardly extending from opposite side of the top wall, jointly defining an upper portion of the passageway; and wherein each of the side walls of the bottom cover defines a first step upwardly supporting the first mating card and a second step upwardly supporting the second mating card, and each of the side walls of the top cover defines a third step downwardly pressing the first mating card and a fourth step downwardly pressing the second mating card.

9. An electrical plug as claimed in claim 8, wherein the shielding case defines a pair of guiding ribs, the first mating card and the second mating card each defining a pair of guiding slot engaging the guiding rib.

10. An electrical plug as claimed in claim 9, wherein the second mating card defines a recess receiving at least part of the third step.

11. An electrical receptacle for mating with a first type plug having two spaced mating printed circuit boards or a second type plug having one mating printed circuit board, comprising:

a housing defining a lower forward mating port and an upper mating port intimately stacked and offset with each other in a vertical direction under condition that the lower mating port extends in front of the upper mating port in a front-to-back direction perpendicular to said vertical direction;

the upper mating port defining an upper mating slot and the lower mating port defining a lower mating slot;

plural pairs of upper contacts defining upper contacting sections respectively located by two sides of the upper mating slot in the vertical direction;

plural pairs of lower contacts defining lower contacting sections respectively located by two sides of the lower mating slot in the vertical direction; and a plurality of insulative wafers side by side arranged with one another along a transverse direction perpendicular to both said vertical direction and said front-to-back direction;

wherein each of said wafers integrates a corresponding pair of upper contacts and corresponding pair of lower contacts which are aligned with each other in the front-to-back direction;

wherein said lower mating slot terminates before the upper mating slot begins in the front-to-back direction; and wherein each of said insulative wafers defines a cutout above the corresponding pair of lower contacts for receive the upper contacting sections of the corresponding pair of upper contacts.

12. The electrical receptacle as claimed in claim 11, wherein the lower mating port defines an upper wall and a lower wall to confine the corresponding lower mating slot, while the upper mating port essentially defines another upper wall to cooperate with said upper wall of the lower mating port for confining the upper mating slot so as to form a low profile thereof.

13. The electrical receptacle as claimed in claim 12, wherein the lower wall is spaced from a bottom face of the housing so as to leave a space under the lower wall for compliance with the second type plug.

14. The electrical receptacle as claimed in claim 13, wherein said housing defines a cutout above the lower mating port and in front of the upper mating port in a side view.

* * * * *